United States Patent [19]

Tomiyama et al.

[11] Patent Number: 4,945,026

[45] Date of Patent: Jul. 31, 1990

[54] IMAGE RECEIVING ELEMENT FOR USE IN A SILVER SALT DIFFUSION TRANSFER PROCESS

[75] Inventors: Hideki Tomiyama; Yukio Karino; Hiroshi Hayashi, all of Kanagawa, Japan

[73] Assignee: Fuji Photo Film Co., Ltd., Kanagawa, Japan

[21] Appl. No.: 418,692

[22] Filed: Oct. 2, 1989

Related U.S. Application Data

[63] Continuation of Ser. No. 249,528, Feb. 26, 1988, abandoned, which is a continuation-in-part of Ser. No. 85,495, Aug. 14, 1987, abandoned.

[30] Foreign Application Priority Data

Aug. 15, 1986 [JP] Japan ..... 61-191224
Aug. 15, 1986 [JP] Japan ..... 61-191225

[51] Int. Cl.[5] ..... G03C 5/54
[52] U.S. Cl. ..... 430/233; 430/232
[58] Field of Search ..... 430/232, 233

[56] References Cited

U.S. PATENT DOCUMENTS 3,873,317 3/1975 Kato et al. ..... 430/232
3,969,541 7/1976 Mukaida et al. ..... 430/232
4,520,096 5/1985 Endo et al. ..... 430/232
4,569,899 2/1986 Inagaki et al. ..... 430/232
4,585,725 4/1986 Sakaguchi ..... 430/232
4,626,495 12/1986 Sakaguchi ..... 430/232
4,689,287 8/1987 Katoh ..... 430/232

*Primary Examiner*—Richard L. Schilling
*Attorney, Agent, or Firm*—Sughrue, Mion, Zinn, Macpeak & Seas

[57] ABSTRACT

An image receiving element for use in a silver salt diffusion transfer process comprising at least an alkali neutralization layer, a neutralization timing layer and an image receiving layer containing silver precipitation nucleus material in regenerated cellulose obtained by saponfying a cellulose ester with a substantially water free alkaline solution after coating disposed on a support in the recited order, wherein the alkaline solution contains from 1 to 20% by weight of a polyhydric alcohol having two or more hydroxyl groups or a derivative thereof. Saponification carried out for forming the image forming layer can be kept from progressing into the layers situated below, thereby enabling the obtainment of satisfactory image receiving sheets with less increase in stains, less density lowering in the storage stability, and less change in the tone.

4 Claims, No Drawings

IMAGE RECEIVING ELEMENT FOR USE IN A SILVER SALT DIFFUSION TRANSFER PROCESS

This is a continuation of application Ser. No. 07/249,528, filed Sep. 26, 1988, which is a continuation-in-part of application Ser. No. 07/085,495 filed Aug. 14, 1987, both now abandoned.

FIELD OF THE INVENTION

This invention concerns a photographic element for use in a silver salt diffusion transfer process and, more specifically, it relates to an image receiving element therefor.

BACKGROUND OF THE INVENTION

A photographic diffusion transfer process utilizing silver salts such as silver halides has heretofore been known. For such a photographic process, a method of directly obtaining a positive silver image on an image receiving element has been known in which a photosensitive element containing an exposed photographic silver halide emulsion and an image receiving element containing silver precipitation nuclei are overlaid on each other and an alkaline processing solution containing a silver halide solvent is coated between these two elements in the presence of a developing agent.

In this method, a positive image is formed directly when an unexposed silver halide emulsion in the photosensitive element is dissolved by the silver halide solvent and leached out as a silver ion complex into the alkaline processing solution, transferred to the image receiving element and precipitated in the image receiving element as a silver image due to the effect of the silver precipitation nuclei.

The layer constitution of the image receiving element comprises, starting from the support, an alkali neutralization layer containing an acidic polymer, a neutralization timing layer comprising cellulose acetate as the main ingredient and an image receiving layer containing silver precipitation nuclei as the fundamental elements, and the image receiving layer is prepared, for example, as described below.

Specifically, U.S. Pat. No. 3,179,517 describes a method of preparing a layer of regenerated cellulose by saponifying an acetyl cellulose film with an alkali, then immersing the regenerated cellulose layer into a gold salt solution and a reducing agent solution, thereby allowing a reaction to occur in the layer to form silver precipitation nuclei of colloidal gold. Further, Japanese Patent Publication No. 32754/69 describes a method of incorporating silver precipitation nuclei in an alkali impermeable polymeric substance by vacuum deposition, then solubilizing the silver precipitation nuclei in a solvent capable of dissolving the polymeric substance, coating the solution on a support followed by drying and then saponifying the surface of the polymer layer, thereby rendering the layer alkali permeable.

Further, Japanese Patent Publication No. 43944/71 describes a method of preparing an image receiving layer by forming silver precipitation nuclei in an acetyl cellulose solution, coating the nucleus solution on a support and then saponifying the acetyl cellulose into regenerated cellulose.

However, the silver iamge formed in the thus obtained image receiving element involves a drawback in that the image is liable to be discolored or faded or a drawback in that stains tend to be caused in white areas during preservation.

For improving such drawbacks, a method of coating a water-soluble polymer solution containing an alkali neutralization ingredient onto the surface of a silver image is described in Japanese Patent Publication No. 5392/71, U.S. Pat. No. 3,533,789 and British Patent No. 1,164,642. However, since the method takes a considerable period of time until the surface coated with the aqueous polymer solution is completely dried and the surface is sticky and adhesive until the drying, printed matter cannot be laid over each other and finger prints or dust is often deposited. In addition, it is troublesome to coat such a solution on the silver image.

Further, with respect to the drawback that the transfer image is decomposed and turns yellow due to hydrogen sulfide present in the atmospheric air, although it has been disclosed in Japanese Patent Application (OPI) No. 10937/72 (the term "OPI" as used herein refers to a "published unexamined Japanese patent application") that the alkalinity in the image receiving layer is reduced, neutralized or rendered somewhat acidic, no sufficient effect can be obtained for various storage conditions by merely lowering the pH value.

Japanese Patent Publication No. 44418/81 discloses an image receiving element comprising, disposed on a support, (I) a layer of cellulose ester, polyvinyl ester or polyvinyl acetal which is hydrolyzable and becomes alkali-permeable upon hydrolysis containing a compound capable of diffusing and changing the property of the silver image, and (II) a regenerated cellulose layer containing silver precipitation nuclei formed therethrough. As compounds which are capable of diffusing and changing the property of the silver image, organic mercapto compounds have been described. In this case, a diffusion transfer processing solution and a mercapto compound in layer (I) are gradually diffused into layer (II) to protect the silver image formed in layer (II) and prevent discoloration or fading.

For completely attaining the effect of preventing discoloration or fading, it is necessary that the mercapto compound has a sufficient property of preventing discoloration or fading and that it remains in layer (I) during preservation of the undeveloped image receiving element and during the diffusion transfer process, penetrates from layer (I) to layer (II) after formation of the silver image by the diffusion transfer process to protect the image formed in layer (II). If the diffusion of the mercapto compound from layer (I) to layer (II) occurs before the completion of the diffusion transfer process, development is suppressed to entirely decrease the optical density of the transferred silver image on the image receiving element. Further, if the diffusion of the mercapto compound occurs too late, the image discolors or fades before the silver image is protected by the mercapto compound.

However, the mercapto compounds described in Japanese Patent Publication No. 44418/81 involve drawbacks in that they perform poorly for preventing the discoloration or fading, thereby causing image discoloration or fading and, in addition, the compounds diffuse from layer (I) to layer (II) while preserving the undeveloped image receiving element, thereby suppressing the development and reducing the optical density of the transferred silver image.

Further, Japanese Patent Application (OPI) No. 120634/74 describes an image receiving element prepared by using a homopolymer, copolymer and graft polymer of monoacrylate or monomethacrylate of a polyhydric alcohol as the polymer layer containing a compound capable of changing the property of the silver image.

However, the compounds described in Japanese Patent Application (OPI) No. 120634/74 also have a similar drawback to that of the compounds described in Japanese Patent Publication No. 44418/81 in that the preventing effect for the discoloration or fading of the image is insufficient, or the optical density of the transferred silver image is decreased while the undeveloped image receiving element is stored.

Further, use of a 2-mercapto-1,3,4-triazole derivative for obtaining a stable silver image in the diffusion transfer process has been disclosed in British Patent No. 1,276,961. Also, U.S. Pat. No. 3,655,380 discloses that 5-seleno-1,2,3,4-tetrazole derivatives can improve the tone of the silver image obtained by the diffusion transfer process into a medium gray tone and can provide a stable silver image as well.

Furthermore, it is also disclosed in Japanese Patent Publication No. 21140/81 and Japanese Patent Application (OPI) No. 500431/81 that the discoloration of the silver image can be prevented by acting on the silver image with a noble metal compound.

The above-mentioned organic mercapto compounds, however, involve a drawback in that the stabilizing effect for the silver images obtained by the diffusion transfer process is insufficient thereby causing discoloration or fading of the image. Further, it has also been found that these noble metal compounds have to be incorporated in a large amount in order to protect the silver image thereby causing stains or asserting undesirable effects on the image forming speed or velocity.

For preventing undesirable diffusion of the silver image stabilizers, Japanese Patent Application (OPI) Nos. 41041/85, 43658/85, etc., disclose attempts at disposing a hydrophilic polymer layer between an alkali impermeable polymer, controlling the saponification degree by utilizing the difference in the diffusion rate of the saponidying solution and, as a result, controlling the diffusion of the added silver image stabilizer. This method, however, brings about a problem in that the manufacturing process is increased by one step and the bonding strength between the hydrophilic layer and hydrophobic layer is weak thereby causing defoliation during production.

Further, an example of adding an image stabilizer to a neutralization layer or neutralization timing layer without disposing the above-mentioned hydrophilic layer is described in Japanese Patent Application (OPI) No. 231537/84 and the result of adding the image stabilizer to the neutralization timing layer and conducting a forcible degradation test for the transfer image is described in Example 4 of that patent. Although this can provide a remarkable effect for the forcible degradation test, the density just after the developing treatment is lower as compared with a sample containing a hydropholic layer as disclosed in Example 5 of the patent. This is due to the addition of water as the saponifying solution which increases the saponifying amount, and the problem cannot be solved by the mere distribution of the image stabilizer to the neutralization layer and/or neutralization timing layer in the case where no hydrophilic layer is present.

However, in the case of obtaining the regenerated cellulose by the method described above, the alkaline solution may sometimes penetrate as far as the neutralization timing layer lying below to partially saponify the cellulose acetate constituting the layer. It will be sufficient that only the image forming layer is saponified into a cellulose membrane. However, if the underlying neutralization timing layer is saponified as well due to the reason described above, the photographic properties, etc., of the image receiving element are adversely affected resulting in undesirable effects. For example, if the hydrophilic cellulose membrane is increased, since the alkaline processing solution coated between the image receiving element and the photosensitive element is adsorbed more on the side of the image receiving element, the image formation is retarded, or the storability after image formation is deteriorated. That is, discoloration and fading of the image when it is left in a light or a dark place is increased. Further, since the drying of the image forming layer just after the peeling of the photosensitive element and image receiving element is retarded, the surface of the layer is liable to be damaged and, depending on the case, the image is partially eliminated.

In order to remove such drawbacks, it is preferred that the saponifying reaction does not progress deeply and that the progress of the saponification from the image forming layer to the underlying layer is suppressed as much as possible.

As one of the means for suppressing the progress of the saponifying reaction from the image forming layer to the underlying layer, an alkaline solution-impermeable intermediate layer may be disposed between the image forming layer and the underlying layer (neutralization timing layer), so that the alkali solution does not permeate to the underlying layer. For example, in a case where the alkaline solution consists of a methanol solvent, the foregoing objects can be attained by using a hydrophilic polymer such as gum arabic, polyacrylamide and gelatin as the intermediate layer. However, this eventually increases the number of coating operations resulting in an economical disadvantage and a decrease in the performance due to the increase in the number of layers (for example, defoliation upon moistening).

As has been described above, it has been impossible in the prior art to provide an image receiving element with a sufficiently high maximum density of a gray (medium gray) tone maintained upon development and capable of forming a finished printed image which is stable for a long period of time upon storage, causes neither discoloration nor fading, results in no stains in the white areas and which can be obtained at a reduced cost.

SUMMARY OF THE INVENTION

Accordingly, it is an object of the present invention to provide an image receiving element capable of ensuring the foregoing performances together.

More specifically, the object of the present invention is to suppress the progress of the saponifying reaction from the image forming layer to the underlying layer as much as possible for preventing the foregoing problems and decreasing the thickness of the regenerated cellulose layer. This results in the effect of shortening the image forming time or processing time, improving the storability of the formed image in light and dark places and increasing the mechanical film strength of the image receiving layer.

The present inventors have made an earnest study and, as a result, found that the foregoing various problems can be overcome by the following image receiving element for use in a silver salt diffusion transfer process:

An image receiving element for use in a silver salt diffusion transfer process comprising at least an alkali neutralization layer, a neutralization timing layer and an image receiving layer containing silver precipitation nucleus material in regenerated cellulose obtained by saponifying a cellulose ester with a substantially water free alkaline solution after coating diposed on a support in the recited order, wherein the alkaline solution contains from 1 to 20% by weight of a polyhydric alcohol having two or more hydroxy groups or a derivative thereof.

The foregoing problems are also overcome by the image receiving element for use in a silver salt diffusion transfer process as described above, wherein the alkali neutralization layer and/or neutralization timing layer comprises at least one of the compounds represented by the following general formula (I) or (II):

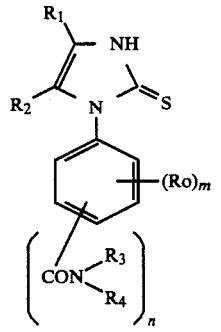

(I)

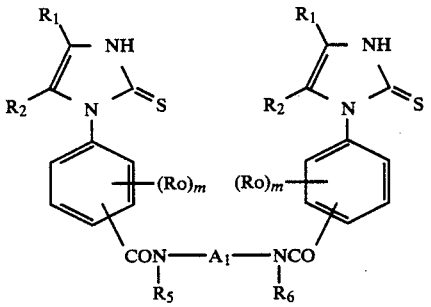

(II)

wherein Ro, which may be the same or different from each other, represents a hydrogen atom, a halogen atom, an alkyl group, a substituted alkyl group, a substituted or unsubstituted cycloalkyl group, an alkoxy group, a substituted alkoxy group, a substituted or unsubstituted alkylsulfonyl group, a substituted or unsubstituted arylsulfonyl group, a sulfamoyl group, an alkyl- or arylsulfonamido group, a carbamoyl group, a carbonamido group, a substituted or unsubstituted heterocyclic group, a substituted or unsubstituted aryl group, an acyl group, a substituted or unsubstituted alkoxycarbonyl group, a substituted or unsubstituted acyloxy group, a substituted or unsubstituted alkylthio group, a substituted or unsubstituted arylthio group, a primary amino group or a salt thereof, a secondary or tertiary amino group substituted with an alkyl or aryl group or a salt thereof, a nitro group, a hydroxy group, a carboxyl group, a sulfonic acid group or a cyano group;

$R_1$ and $R_2$ represent a hydrogen atom, an alkyl group, a substituted alkyl group or an aryl group;

$R_3$ and $R_4$ represent a hydrogen atom, an alkyl group, a substituted alkyl group, an aryl group, a substituted aryl group or a substituted or unsubstituted heterocyclic group;

$R_3$ and $R_4$ may form together with the N atom a 5- to 6-membered ring in which a hetero atom may further be included;

$R_5$ and $R_6$ represent a hydrogen atom, an alkyl group, a substituted alkyl group, an aryl group, a substituted aryl group or a substituted or unsubstituted heterocyclic group;

$A_1$ represents a divalent group; m represents 0 or an integer of from 1 to 4; and n represents 0, 1 or 2.

DETAILED DESCRIPTION OF THE INVENTION

In the foregoing general formulae (I) and (II), Ro, which may be the same or different from each other, represents a hydrogne atom, a halogen atom (for example, F, Cl, Br), an alkyl group, preferably an alkyl group of 1 to 14 carbon atoms (for example, a methyl group and an ethyl group), a substituted alkyl group, preferably a substituted alkyl group having 1 to 14 carbon atoms in the alkyl moiety, a substituted or unsubstituted cycloalkyl group, preferably, of 3 to 14 carbon atoms, an alkoxy group, preferably, of 1 to 14 carbon atoms, a substituted alkoxy group, preferably, of 1 to 14 carbon atoms (for example, a methoxy group and an ethoxy group), a substituted or unsubstituted alkylsulfonyl group, preferably, of 1 to 14 carbon atoms, a substituted or unsubstituted arylsulfonyl group, preferably, of 6 to 14 carbon atoms, a sulfamoyl group (wherein the nitrogen atom in the sulfamoyl group may be substituted with an alkyl group, a substituted alkyl group, a cycloalkyl group, a substituted cycloalkyl group, an aryl group and a substituted aryl group of not more than 14 carbon atoms, or a substituted or unsubstituted 5- to 7-membered heterocyclic group containing one or more of a nitrogen atom, an oxygen atom or a sulfur atom, and in which two substituents on the nitrogen atom may join together to form a ring), an alkyl- or arylsulfonamido group (wherein the alkyl moiety or aryl moiety may include a substituent, and the nitrogen atom of the sulfonamido group may be substituted with an alkyl group, a substituted alkyl group, a cycloalkyl group, a substituted cycloalkyl group, an aryl group and a substituted aryl group of not more than 14 carbon atoms, or a 5- to 7-membered substituted or unsubstituted heterocyclic group containing one or more of a nitrogen atom, an oxygen atom or a sulfur atom), a carbamoyl group (wherein the nitrogen atom of the carbamoyl group may be substituted with an alkyl group, a substituted alkyl group, a cycloalkyl group, a substituted cycloalkyl group, an aryl group and a substituted aryl group of not more than 14 carbon atoms, or a 5- to 7-membered substituted or unsubstituted heterocyclic ring containing one or more of a nitrogen atom, an oxygen atom or a sulfur atom, and two substituents on the nitrogen atom may join together to form a ring), a carbonamido group (wherein the nitrogen atom of the carbonamido group may be substituted with an alkyl group, a substituted alkyl group, a cycloalkyl group, a substituted cycloalkyl group, an aryl group, a substituted aryl group of not more than 14 carbon atoms or a substituted or unsubstituted 5- to 7-membered heterocyclic ring containing one or more of a nitrogen atom, an oxygen atom or a sulfur atom), a substituted or unsubstituted heterocyclic group, preferably a substituted or unsubstituted 5- to 7-membered heterocyclic group containing one or more of a nitrogen atom, an oxygen atom or a sulfur atom (for example, a thiophene, a thiazole, a furan, a pyran, a pyrrole, an inidazole, a triazole, a triazine, a pyridine, a pyrimidine, a piperidine, and an oxazole), a substituted or unsubstituted aryl group, preferably, of not more than 14 carbon atoms, an acyl group, preferably, of not more than 14 carbon atoms, a substituted or unsubstituted alkoxycarbonyl group, preferably, of 2 to 14 carbon atoms, a substituted or unsubstituted acyloxy group, preferably, of 2 to 14 carbon atoms, a substituted or unsubstituted alkylthio group, preferably, of 1 to 14 carbon atoms, a substituted or unsubstituted arylthio group, preferably, of 6 to 14 carbon atoms, a primary amino group or its salt, a secondary and tertiary amino group substituted with an alkyl group of 1 to 14 carbon atoms or an aryl group of 6 to 14 carbon atoms, or a salt thereof (wherein the alkyl or aryl group may have a substituent), a nitro group, a hydroxy group, a carboxyl group, a sulfonic acid group or a cyano group.

$R_1$ and $R_2$ each represents a hydrogen atom, an alkyl group, preferably, of 1 to 14 carbon atoms (for example, a methyl group or an ethyl group), a substituted alkyl group, preferably, of 1 to 14 carbon atoms in the alkyl moiety (for example, a methoxyethyl group, an ethoxyethyl group, a chloroethyl group or a phenylmethyl group), or an aryl group (for example, a phenyl group and a naphthyl group).

$R_3$ and $R_4$ each represents a hydrogen atom, an alkyl group, preferably, of 1 to 14 carbon atoms (for example, a butyl group, a hexyl group or an octyl group), a substituted alkyl group, preferably, of 1 to 14 carbon atoms in the alkyl moiety (for example, a methoxymethyl group, a phenylmethyl group, or a hydroxyethyl group), an aryl group (for example, a phenyl group or a naphthyl group), a substituted aryl group, or a substituted or unsubstituted heterocyclic group, preferably a substituted or unsubstituted 5- to 7-membered heterocyclic group containing one or more of a nitrogen atom, an oxygen atom or a sulfur atom (for example, a thiophene, a thiazole, a furan, a pyran, a pyrrole, an imidazole, a triazole, a triazine, a pyridine, a pyrimidine, a piperidine, and an oxazole) and $R_3$ and $R_4$ may form together with the N atom a 5- or 6-membered ring (for example, a piperidine ring or a morpholine ring) and a hetero atom may further be included in the ring.

$R_5$ and $R_6$ each represents a hydrogen atom, an alkyl group, preferably, of 1 to 6 carbon atoms (for example, a methyl group or an ethyl group), a substituted alkyl group, preferably, of 1 to 6 carbon atoms in the alkyl moiety (for example, a methoxyethyl group, a hydroxyethyl group and a phenylmethyl group), an aryl group (for example, a phenyl group), a substituted aryl group, or a substituted or unsubstituted heterocyclic group, preferably a substituted or unsubstituted 5- to 7-membered heterocyclic group containing one or more of a nitrogen atom, an oxygen atom or a sulfur atom (for example, a thiophene, a thiazole, a furan, a pyran, a pyrrole, an imidazole, a triazole, a triazine, a pyridine, a pyrimidine, a piperidine, and an oxazole).

The substituent for each of the substituted groups represented by Ro include, for example, an alkoxy group (for example, a methoxy group or an ethoxy group), a halogen atom (for example, Cl or Br) or a phenyl group.

The substituents for the substituted alkyl group represented by $R_1$ and $R_2$ include, for example, an alkoxy group (for example, a methoxy group or an ethoxy group), a halogen atom (for example, Cl or Br) or a phenyl group.

The substituents for the substituted alkyl group represented by $R_3$ to $R_6$ include, for example, an alkoxy group (for example, a methoxy group or an ethoxy group), a halogen atom (for example, Cl or Br), a phenyl group or a hydroxy group.

The substituents for the substituted aryl group represented by $R_3$ to $R_6$ include, for example, an alkyl group (for example, a methyl group or an ethyl group), an alkoxy group (for example, a methoxy group or an ethoxy group) and a halogen atom (for example, Cl or Br).

The substituents for the substituted heterocyclic group represented by $R_3$ to $R_6$ include, for example, an alkyl group, preferably, of 1 to 14 carbon atoms (for example, a methyl group or an ethyl group).

$A_1$ represents a divalent group. Preferred divalent groups include the following: $-(CH_2)_{n_1}O_2-(CH_2)_{n_1}$ wherein $n_1$ is an integer of from 1 to 6, $-(CH_2)_{n_2}$ wherein $n_2$ is an integer of from 2 to 12,

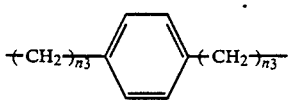

wherein $n_3$ is an integer of from 0 to 4 $-(CH_2)_{n_2}A_2-(CH_2)_{n_4}$ wherein $n_4$ is an integer of from 1 to 6, and $A_2$ represents

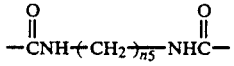

wherein $n_5$ is an integer of from 2 to 10.

m represents 0 or an integer of from 1 to 4, and n represents 0, 1 or 2.

The alkyl group or the alkyl moiety represented by $R_1$ to $R_6$ may be linear or branched.

The compound of the general formula (I) wherein $R_1$, $R_2$ and $R_4$ represent a hydrogen atom, m is 0, n is 1 and $R_3$ is an alkyl group of 4 to 14 carbon atoms or a substituted alkyl group of 4 to 14 carbon atoms in the alkyl moiety is preferred.

The compound of the general formula (II) wherein $R_1$, $R_2$, $R_5$ and $R_6$ represent a hydrogen atom, m is 0 and $A_1$ represents an alkylene group of 2 to 8 carbon atoms is preferred. Further, it is particularly preferred that $A_1$ represents an ethylene group, a propylene group, a butylene group, a pentylene group, a heptylene group or an octylene group.

Effective compounds among those represented by the general formulae (I) or (II) are exemplified below but is should be noted that the present invention is in no way limited only to these compounds.

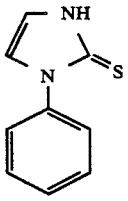
1
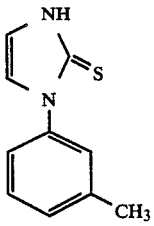
2
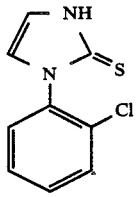
3
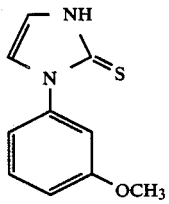
4
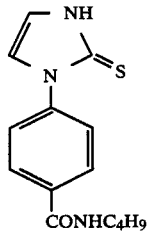
5
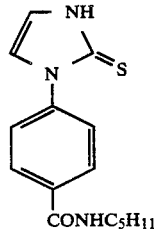
6
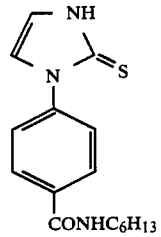
7

-continued
8
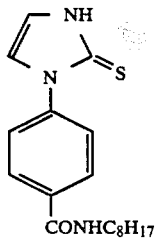
9
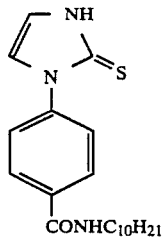
10
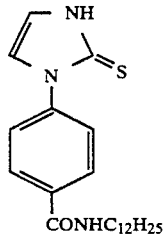
11
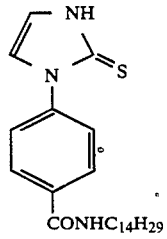
12
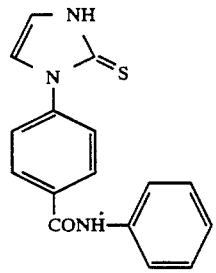
13
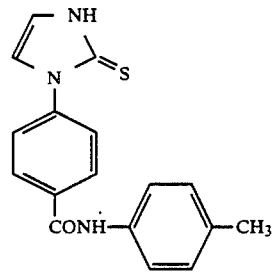

-continued
14
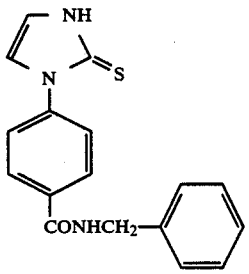
15
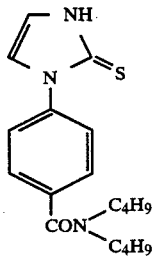
16
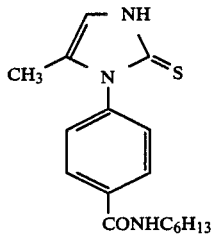
17
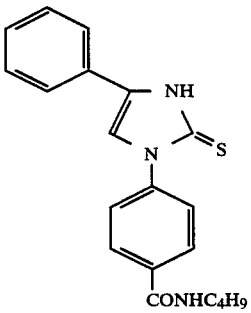
18
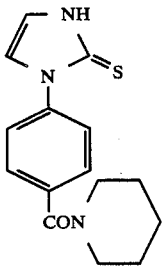
19
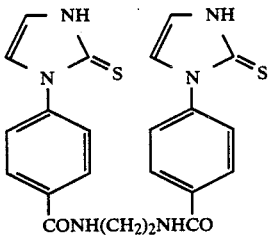

-continued
20
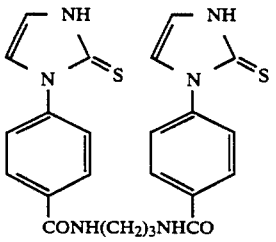
21
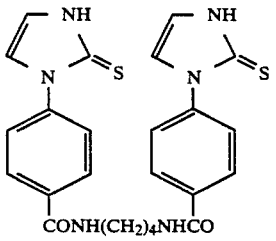
22
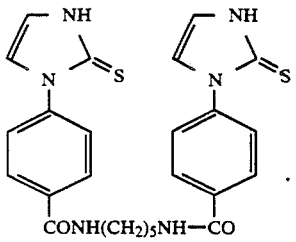
23
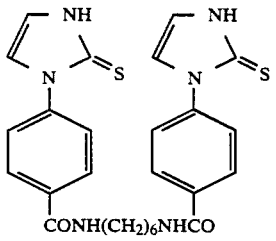
24
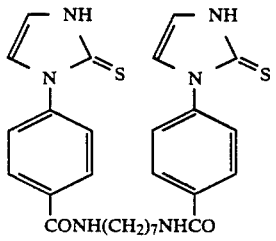
25
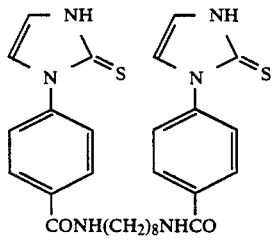

-continued
26
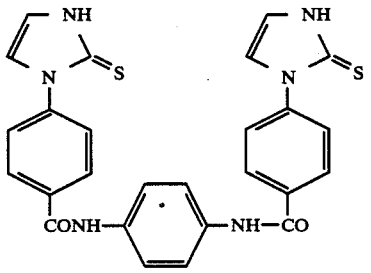
27
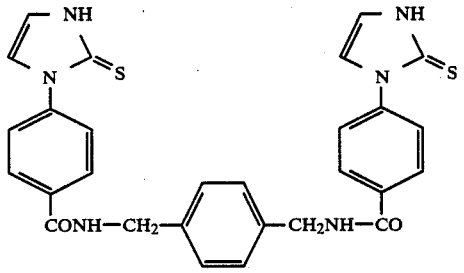
28
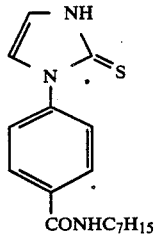
29
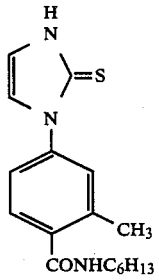
30
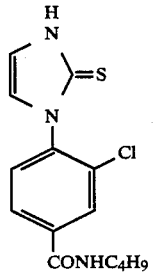
31
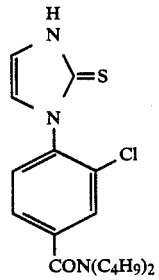

-continued
32
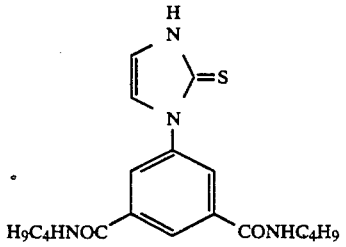
33
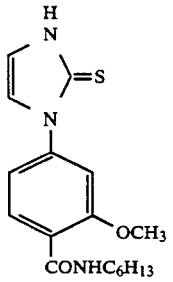
34
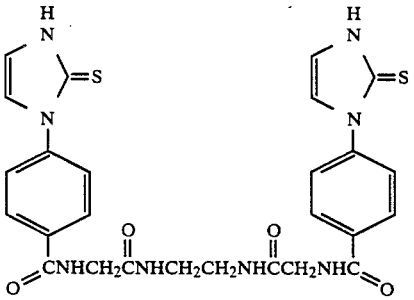
35
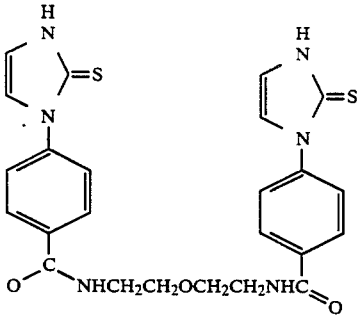
36
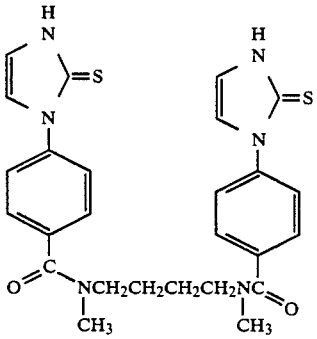

-continued

37

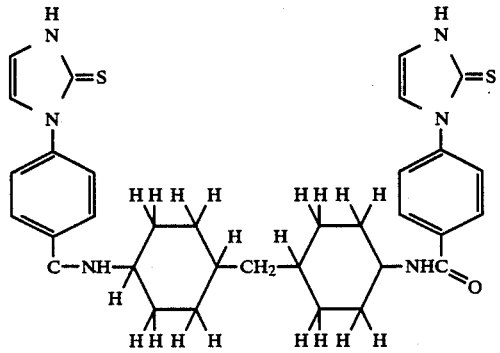

38

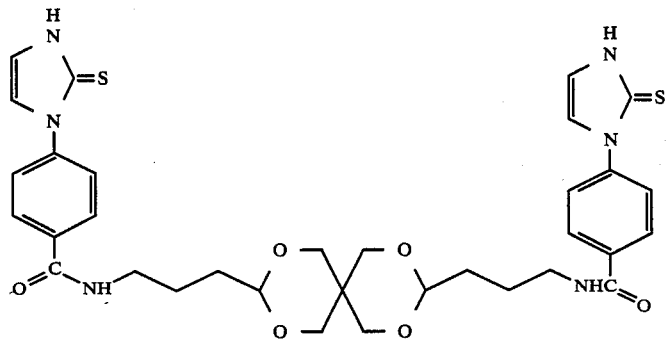

The compounds of the general formulae (I) and (II) according to the present invention can be synthesized by known methods and several of these compounds can be synthesized by the synthesizing method as described in Japanese Patent Application (OPI) No. 231537/84.

The compounds of the general formulae (I) and (II) also known as image stabilizers in this invention are added at least to the neutralization layer and, for controlling and improving the tone, gradation and sensitivity upon processing and storage after processing of the silver image, they can also be added to the neutralization timing layer and/or image receiving layer and/or other auxiliary layer.

Although the addition amount is different depending on the amount of precipitated silver, etc., the image stabilizer is generally coated in an amount of from $1.0\times10^{-4}$ to $1.65\times10^{-3}$ mol/m$^2$, and preferably from $2.0\times10^{-4}$ to $13.2\times10^{-4}$ mol/m$^2$ The present invention has been attained based on the finding that the progress of the saponifying reaction to the underlying layer can be suppressed by adding 1 to 20% by weight of a polyhydric alcohol containing two or more of hydroxy groups or a derivative thereof to an alkaline solution used for the saponifying reaction.

For example, in the case of saponifying a cellulose ester layer by adding glycerin to a methanol solution of sodium hydroxide as an alkaline solution, the progress of the saponification can be suppressed as compared with the case of not adding the glycerin.

The polyhydric alcohol or the derivative thereof to be added includes, preferably, glycerin, ethylene glycol, diethylene glycol, diglycerin, triglycerin, trishydroxymethylpropane, trishydroxymethylethane, monoacetin, diacetin and triacetin either alone or in admixture of two or more, but this invention is in no way limited only to these examples. The most preferred compound is glycerin. The amount of the polyhydric alcohol or the derivative thereof added to the alkaline saponifying solution is preferably from 1 to 20% by weight, and more preferably from 6 to 12% by weight, based on the total amount of the complete solution.

As the alkaline compound for use in the alkaline solution, a hydroxide of an alkali metal, for example, sodium hydroxide or potassium hydroxide is preferred. Further, a lower alcohol, for example, xethanol or ethanol is preferred as a solvent.

The "substantially water free alkaline solution" of the present invention means that water is not intentionally added into a alkaline solution in the formula. For example, it is irrelevant with the water which is present in a solvent (e.g., methanol) as an impurity and the water which is absorbed from atmosphere during preparation. In fact, since the water content of a methanol for industrial use is extremely little (e.g., less than 0.7% in JIS K1501-63), it does not affect the performance of the products of the present invention, thus it can be regarded as the substantially water free.

The image receiving layer at least contains silver precipitation nuclei and at least a portion of the binder comprises regenerated cellulose derived by saponifying a cellulose ester. The method of preparing the image receiving layer includes a method of saponifying an acetylcellulose layer with an alkali to form a layer of regenerated cellulose, then immersing the regenerated cellulose layer into a solution of a metal salt and a solution of a reducing agent, thereby allowing the metal salt and reducing agent to react in the layer to form silver precipitation nuclei of a colloidal metal as disclosed in U.S. Pat. No. 3,179,517; a method of incorporating silver precipitation nuclei into a cellulose ester by way of vacuum deposition, dissolving the cellulose ester in a solvent and then coating and drying followed by saponification into regenerated cellulose as disclosed in Japanese Patent Publication No. 32754/69; and a method of forming silver precipitation nuclei in a solution of acetylcellulose, coating the solution onto the image receiving element and then saponifying to form regenerated cellulose as described in Japanese Patent Publication No. 43944/71. Any of the methods can incorporate the inventive feature of adding from 1 to 20% by weight of a polyhydric alcohol containing 2 or more hydroxyl groups or a derivative thereof to an alkaline saponifying solution.

The object of the present invention is to provide a method in which the saponifying reaction to the layer below the image forming layer does not progress deeply in an image receiving element for use in a silver salt diffusion process by adding a polyhydric alcohol or a derivative thereof to an alkali saponifying solution.

The diffusion transfer process is well known in the relevant field of art and is described in detail in, for example, A. Rott and E. Weyde, *Photographic Silver Diffusion Transfer Process*, Focal Press, London; C. B. Neblette, *Handbook of Photography and Reprography*, Seventh Edition (1977), chapter 12 (One-Step Photography), Van Nostrand Reinhold; Heist, *Modern Photographic Processing*, Vol. 2, chapter 8 (Diffusion Transfer), etc.

In the diffusion transfer process, many kinds of photographic materials can be prepared. That is, it is known that transferred silver images can be obtained by overlaying a photosensitive material comprising a photographic silver halide photographic emulsion coated on a support and an image receiving material comprising an image receiving layer containing silver precipitation nuclei coated on another support on each other and extending an alkaline processing composition (e.g., high or low viscosity alkaline processing compositions containing a developing agent and a silver halide solvent) as the processing element between the two materials, and such a photographic material can be used advantageously in practicing the present invention.

Further, there is known another photographic material as described in U.S. Pat. No. 2,861,885, in which a photosensitive layer and an image receiving layer are coated while being overlaid on each other on one support and a positive image can be observed through a negative image by utilizing a high covering power of the positive image. A further photographic material in which the same constituent materials as described above are used but only the positive image is obtained by washing out the photosensitive material layer after the diffusion transfer process is also known.

In addition, a photographic material of a laminated integral structure in which a photosensitive layer and an image receiving layer are disposed on one identical support and which can be used without separating the photosensitive element and the image receiving element after the diffusion transfer process is known.

Details for each of the various photographic materials have been described in the literature references cited above.

The photosensitive element used in the present invention comprises a photosensitive layer containing one or more silver halide emulsions on a support. As the silver halide, silver iodobromide at high sensitivity (from 3 to 10 mol% of iodine content) is particularly preferred. The silver halide is added by being dispersed in an adequate protective colloidal material, for example, gelatin, agar, albumin, casein, collodion, a cellulose type material such as carboxymethyl cellulose, a vinyl polymer such as polyvinyl alcohol or a linear polyamide, such as polyhexamethylene adipamide. An emulsion suitable for such use can be prepared by the method described, for example, in P. Glafkides, *Chimie et Physique Photographique* (Paul Montel, 1967); G. F. Duffin, *Photographic Emulsion Chemistry* (The Focal Press, 1966); V. L. Zelikman et al., *Making and Coating Photographic Emulsion* (The Focal Press, 1964), etc.

These silver halide emulsions can be subjected, as required, to chemical sensitization, spectral sensitization and supersensitization. Further, commonly known antifogging agents, hardening agents, development accelerators, surface active agents, antistatic agents, etc., can be incorporated into the emulsions.

It is also useful to provide a protective layer on the photosensitive layer to physically protect the photosensitive layer and, further, to add matting agent particles to the protective layer for improving the surface smoothness and preventing adhesion.

While various processing compositions may be used as the processing element for use in the present invention, the processing composition may preferably contain a developing agent, a silver halide solvent and an alkali agent and, depending on the purpose, the developing agent and/or silver halide solvent may be incorporated in the photosensitive element and/or image receiving element.

Suitable silver halide developing agents include, for example, benzene derivatives in which at least two hydroxyl and/or amino groups are substituted at the ortho- or para-position on the benzene ring, for example, hydroquinone, amidol, metol, glycine, p-aminophenol and pyrogallol; and hydroxylamines, particularly primary and secondary aliphatic and aromatic N-substituted or $\beta$-hydroxylamines which are soluble in aqueous alkali, for example, hydroxylamine, N-methylhydroxylamine, N-ethylhydroxylamine and those described in U.S. Pat. No. 2,859,276 issued to Edwin H. Land, et al., and N-alkoxyalkyl-substituted hydroxylamines as described in U.S. Pat. No. 3,293,034 issued to Miltongreen, et al.

Further, hydroxylamine derivatives having tetrahydrofurfuryl groups as described in Japanese Patent Application (OPI) No. 88521/74 can also be used.

Further, aminoreductones as described in West German Patent Application (OLS) Nos. 2,009,054, 2,009,055 and 2,009,078 and heterocyclic aminoreductones as described in U.S. Pat. No. 4,128,425 may also be used.

Further, tetraalkyl reductic acid described in U.S. Pat. No. 3,615,440 may be used.

Furthermore, an auxiliary developing agent such as phenidone compounds, p-aminophenyl compounds and ascorbic acid and a processing composition described above can be used together.

Suitable silver halide solvents can include the usual fixing agents, for example, sodium thiosulfate, sodium thiocyanate, ammonium thiosulfate and those described in U.S. Pat. No. 2,543,181; as well as combinations of cyclic imides and nitrogen base compounds, for example, combinations of barbiturate or uracil and ammonia or an amine, as well as those combinations described in U.S. Pat. No. 2,857,274, issued to Edwin H. Land.

Further, 1,1-bissulfonylalkane and derivatives thereof are also known and can be used as the silver halide solvent in the present invention.

The processing composition also contains alkalis, preferably hydroxides of alkali metals, for example, sodium hydroxide or potassium hydroxide. When the processing composition is applied by distributing it as a thin layer between an overlaid photosensitive element and an image receiving element, the processing composition may preferably contain a polymeric film forming agent, a thickener or a viscosity improver. Hydroxyethyl cellulose and sodium carboxymethyl cellulose are particularly useful for this purpose and they are incorporated into the processing solution at an effective concentration to provide an adequate viscosity according to known principles of the diffusion transfer photographic process. Further, the processing composition may also include other auxiliary agents known in the silver salt diffusion transfer process, for example, an antifogging agent, toning agent, stabilizer, etc.

The image receiving element for use in the present invention comprises, as a basic layer constitution, an alkali neutralization layer, a neutralization timing layer and an image receiving layer disposed in this order on the support. In addition, the image receiving element may also contain an image stabilizing layer as described in Japanese Patent Application (OPI) No. 167949/86, for example, an iodine ion capturing layer or a separation layer, which can provide a further excellent effect in the present invention.

Further, another hydrophilic polymer layer may be disposed as required between the image receiving layer and the neutralization timing layer. The polymer used for the hydrophilic polymer layer can include, for example, a gelatin, a gelatin derivative (for example, phthalated gelatin), a saccharide (for example, starch, galactomannan, gum arabic, hydroxyethyl cellulose, methyl cellulose, carboxymethyl cellulose, pullulan, hydroxypropyl cellulose, etc.), a hydrophilic synthetic high molecular weight material (for example, polyacrylamide, polymethylacrylamide, poly-N-vinylpyrrolidone, 2-hydroxyethylmethacrylate, etc.).

In a preferred embodiment, a hydrophilic polymer layer other than the layer mainly composed of regenerated cellulose is not present between the neutralization timing layer and the image receiving layer.

Further, for the purpose of improving the releasability of the processing solution, it is also effective to coat, on the image receiving layer, a layer of a hydrophilic polymer, for example, carboxymethyl cellulose, gelatin, gum arabic, dimethylhydantoinformaldehyde condensate, cellulose acetate hydrogenphthalate, etc.

Furthermore, a brightening agent may also be added for improving the whiteness and, addition of a plasticizer is also effective for further softening the coated polymer layer.

The support for the image receiving element in the present invention may be a hard material such as glass or ceramic or a flexible material such as paper or film. It is in any case important to select those materials causing no remarkable dimensional change during storage or processing. Such a support may be transparent or not transparent and it can include, for example, a polyester film, a polycarbonate film, a polystyrene film, a cellulose derivative film, paper, baryta paper, paper coated with a pigment such as titanium white, and papers laminated on the surface thereof with a polymer such as polyethylene, polystyrene and cellulose derivatives. It is most common in the image receiving element according to the present invention that it takes a sheet-like form having a flexible material as the support.

More specifically, paper supports such as of baryta paper, polyethylene laminated paper, lacquor and synthetic paper, or film supports such as acetylcellulose, polyethylene terephthalate and polystyrene are usually employed, with polyethylene laminated paper being particularly preferred The alkali neutralization layer usable in the present invention is, for example, a polymer acid as described in Japanese Patent Publication No. 33697/73. Preferred polymer acids include maleic acid anhydride copolymers, for example, a styrene-maleic acid anhydride copolymer, a methyl vinyl ether-maleic acid anhydride copolymer, an ethylene-maleic acid anhydride copolymer, etc., (meth)acrylic acid (co)polymers, for example, an acrylic acid-alkyl acrylate copolymer, an acrylic acid-alkyl methacrylate copolymer, a methacrylic acid-alkyl acrylate copolymer, a methacrylic acid-alkyl methacrylate copolymer, etc. Further, the hydrolyzable alkali-impermeable polymer or alkali-permeable polymer as described above may be used in admixture with the polymer acid with an aim of improving the physical properties of the film.

The neutralization timing layer preferably includes a hydrolyzable alkali-impermeable polymer, for example, cellulose esters such as a cellulose acetate, a cellulose propionate and a cellulose acetate butyrate.

The optimum value for the coating amount of the polymer acid varies depending on the amount of alkali contained in the processing solution and it is preferably from 25 to 150% (molar ratio) and, more preferably, from 40 to 100% (molar ratio) based on the amount of alkali in the processing solution.

As the cellulose ester usable in the alkali neutralization layer, the neutralization timing layer and the image receiving layer before saponification in the present invention, any of cellulose esters in which hydroxyl groups are partially or entirely esterified may be used and they can include cellulose esters of aliphatic acids such as cellulose acetate, cellulose propionate and cellulose butyrate, cellulose sulfate, cellulose phosphate and nitrocellulose. Further, mixed esters such as cellulose nitrate acetate may also be used.

The optimum value for the degree of substitution of hydroxyl groups into esters of the cellulose has to be selected for each of the cellulose esters depending on the solvent composition used, saponifying reaction rate and the photographic process for the image receiving layer (adsorption rate of dissolved silver) and, accordingly, it cannot be defined generally. In fact, it is considerably restricted from the solvent composition at the time of sample preparation in view of the solubility. Finally, it depends on the activity, the photographic density and so on of the obtained sample.

A preferred cellulose ester is an aliphatic acid ester of cellulose and most preferred is cellulose acetate.

The present invention is preferably practiced by using cellulose acetate having a degree of substitution preferably from 1.53 (40% acetylation degree) to 27 (58% acetylation degree), and more preferably the degree of substitution is from 1.7 to 2.6.

The coating amount of the cellulose acetate in the neutralization timing layer for use in the present invention is from 2 to 12 $g/m^2$, and preferably from 5 to 10 $g/m^2$.

The coating amount of the cellulose acetate used in the alkali neutralization layer is from 1 to 10 $g/m^2$, preferably from 2 to 7 $g/m^2$, and the coating amount of the cellulose acetate used in the receiving layer is from 0.2 to 6 $g/m^2$, preferably from 0.5 to 4 $g/m^2$.

A preferred embodiment of the image receiving layer of the image receiving element in the present invention is a layer containing a substance as a catalyst for the reduction reaction of a water-soluble silver complex salt in the silver salt diffusion transfer process (referred to as silver precipitation nucleus material or developing nuclei) in a matrix material capable of allowing an alkali processing composition to permeate therethrough. The matrix material capable of allowing the alkali processing composition to permeate therethrough is regenerated cellulose obtained by alkali saponifying the cellulose ester as described above.

Examples of suitable silver precipitation nucleus materials include, for example, heavy metals such as iron, lead, zinc, nickel, cadmium, tin, chromium, copper, cobalt, particularly, noble metals, for example, gold, silver, platinum and palladium. Other useful silver precipitation nucleus materials include, for example, sulfides and selenides of heavy metals, particularly, sulfides of mercury, copper, aluminum, zinc, cadmium, cobalt, nickel, silver, palladium, lead, antimony, bismuth, cerium and magnesium as well as selenides of lead, zinc, antimony and nickel.

As has been known in the prior art, the silver precipitation nucleus material is present in an extremely small amount, for example, from about 1 to $25\times10^{-6}$ mol/m$^2$ Usually, it is used at the minimum level allowable , because excess silver is precipitated or undesirable background density results in the highlight region if the concentration is higher. A mixture of silver precipitating nucleus materials may also be used. The image receiving layer can be said substantially colorless or transparent by lessening the amount of silver precipitating nuclei to reduce the coloring influence of the silver precipitating nuclei.

Further, benzimidazoles, mercaptoimidazoles, mercaptopyrimidines and benzotriazoles, as well as those compounds as described in A. Rott and E. Weyde, *Photographic Silver Diffusion Transfer Processes*, chapters 3, 2, 4, 4, pp. 61–65, The Focal Press, London (1972), U.S. Pat. No. 3,765,825, German Patent No. 1,903,741, British Patent No. 1,230,470 and French Patent No. 2,090,476 is effectively used as a toning agent in the image receiving layer.

Since the toning agent has to act to the silver precipitation nuclei just from the initial stage where the silver starts to precipitate, it is preferably added in the image receiving layer and/or processing solution.

However, if the toning agent is added alone in a great amount to the image receiving layer to obtain a satisfactory tone, it causes a drawback of suppressing the development and lowering the image density. In view of the above, although the toning agent is necessary for the image receiving layer, it is also necessary to limit the addition amount to the minimum level to avoid the undesirable effects on the image density.

The amount of the toning agent used in the present invention is from about $5\times10^{-6}$ to $1\times10^{-3}$ mol/m$^2$.

The present invention will now be described by reference to specific examples which are not meant to be limiting.

Unless otherwise specified, all percents, ratios, etc., are by weight.

EXAMPLES

Determination of the Saponification Degree

After coating cellulose acetate (acetylation degree: 55%) in an amount of 9 g/m$^2$ on a polyethylene terephthalate support, the surface of the coated film was saponified by an alkali solution of the composition shown in Table 1 to form a regenerated cellulose layer thereby preparing specimens.

TABLE 1

| Specimen No. | Composition of Alkali Saponifying Solution | | | |
|---|---|---|---|---|
| | Polyhydric Alcohol | | NaOH | Methanol |
| Comparison | — | | 9 g | 300 ml |
| 1 | Glycerin | 18 g | " | " |
| 2 | " | 24 g | " | " |
| 3 | " | 36 g | " | " |
| 4 | Trishydroxymethylpropane | 24 g | " | " |
| 5 | Triacetin | 24 g | " | " |

The progressing degree of saponification (saponifying degree) was evaluated by the quantitative determination of residual acetyl groups by neutralizing titration, and the saponification depth was evaluated by observation with a transmission type electronic microscope (TEM) for each of the specimens. The results are shown in Table 2.

TABLE 2

| Specimen No. | Saponification Degree (neutralization titration) (%) | Saponifying Depth (TEM) (μm) |
|---|---|---|
| Comparison | 61.0 | 3.0 |
| 1 | 49.7 | 2.4 |
| 2 | 41.2 | 0.8 |
| 3 | 31.3 | 0.7 |
| 4 | 28.0 | 0.6 |
| 5 | 5.9 | 0.4 |

As is apparent from the results, the progress of the saponifying reaction of the present specimens can substantially be suppressed as compared with that in the comparative specimen and the thickness of the regenerated cellulose layer can be decreased by adding polyhydric alcohol or a derivative thereof.

EXAMPLE 1

1. Preparation of Image Receiving Sheet

The following layers were formed successively on a polyethylene laminate paper as a support. Numerical values within "( )" represent the coating amount in g/m$^2$.

(1) Neutralization Layer

Cellulose acetate (acetylation degree: 53%) (6), methyl vinyl ether-maleic acid anhydride copolymer (4), uvitex OB (trade name of product manufactured by Ciba Geigy Co.) (0.04), titanium dioxide (0.05).

(2) Neutralization Timing Layer

Cellulose acetate (acetylation degree: 55%) (8.5), 1-(4-hexylcarbamoylphenyl)-2,3-dihydroimidazole-2-thione (0.06).

(3) Image Receiving Layer

Regenerated cellulose layer prepared by saponifying under the same conditions as in the experiment for the saponification degree by using saponification solutions shown in Table 1 (for the comparison, Specimen No. 1 and Specimen No. 2) on the surface after coating cellulose acetate (1.5) containing palladium sulfide ($1.5\times10^{-3}$) and 2-mercaptobenzimidazole ($2.5\times10^{-3}$).

(4) Separation Layer

Butyl methacrylate-acrylic acid copolymer (molar ratio: 15:85) (0.03).

2. Preparation of Photosensitive Sheet

The following layers were disposed successively on a support (black polyester film):

(1) Silver iodobromide with average grain size of 1.0 μm (iodine content of 6.5 mol%) (0.59 g/m$^2$ as the amount of silver), gelatin (3.5).

(2) Protective Layer

Gelatin (0.7), polymethylmethacrylate particles (0.1)

3. Processing Solution

| | |
|---|---|
| Potassium hydroxide (an aqueous 40% KOH solution) | 323 cc |
| Titanium dioxide | 3 g |
| Hydroxyethyl cellulose | 79 g |
| Zinc oxide | 9.75 g |
| N,N-Bismethoxyethylhydroxylamine | 75 g |
| Triethanolamine solution (4.5 parts of triethanolamine based on 6.2 parts of water) | 17.14 g |
| Tetrahydropyrimidinethione | 0.4 g |
| 2,4-Dimercaptopyrimidine | 0.35 g |
| Uracil | 80 g |
| Water | 1,193 g |

An optical wedge exposure was conducted for the photosensitive sheet by using a sensitometer having an optical source at the color temperature of 5,400° K. The photosensitive sheet after the exposure and each of the respective image receiving sheets were overlaid and diffusion transfer development was conducted while extending the above-mentioned processing solution therebetween to a thickness of 0.035 mm, and positive prints separated at different separation times, i.e., 30 seconds and 5 minutes, were prepared.

The optical density was measured by using a TCD type automatic recording densitometer may be Fuji Photo Film Co., Ltd. and the maximum density was compared for each of the specimens (Table 3).

TABLE 3

| | Maximum Density (Dmax) | |
|---|---|---|
| Specimen No. | Separation after 30 Seconds | Separation after 5 Minutes |
| Comparison | 1.68 | 1.81 |
| 1 | 1.80 | 1.81 |
| 2 | 1.81 | 1.81 |

The maximum density was completed at 1.81 and the above results show that the image was completed upon 5 minute separation for each of the specimens, but the image was not completed for the comparative specimen upon 30 second separation. In contrast, the image was completed even upon 30 second separation in Specimens 1 and 2 according to the present invention showing that the image forming rate is high.

EXAMPLE 2

As the accelerated degradation test for the image, the positive prints prepared in Example 1 were stored at 60° C. and 90% RH for 7 days and then subjected again to the optical density measurement by the same methods as described above. The degree of degradation for the image was evaluated by means of the degree of reduction from the optical density 0.5 before the preservation (ΔD). As the value for ΔD becomes smaller, the image shows less degradation and is more stable. The results are shown in Table 4.

TABLE 4

| | Image Degradation Degree (ΔD) | |
|---|---|---|
| Specimen No. | 30 Second Separation | 5 Minute Separation |
| Comparison | 0.110 | 0.163 |
| 1 | 0.082 | 0.119 |
| 2 | 0.058 | 0.089 |

It can be seen that Specimens 1 and 2 according to the present invention are excellent in image stability relative to the comparative specimen.

EXAMPLE 3

Positive prints were prepared in the same manner as in Example 1 for Specimen Nos. 3, 4 and 5 of Table 1 and the same experiment as in Example 2 was carried out to obtain satisfactory results as shown in Table 5.

TABLE 5

| | Image Degradation Degree (ΔD) | |
|---|---|---|
| Specimen No. | 30 Second Separation | 5 Minute Separation |
| 3 | 0.052 | 0.081 |
| 4 | 0.050 | 0.079 |
| 5 | 0.047 | 0.075 |

EXAMPLE 4

Preparation of Image Receiving Sheet

1. Preparation of Image Receiving Sheet (A)

The following layers were successively disposed on a polyethylene laminated paper as a support to prepare an image receiving sheet (A). Numerical values in "( )" represent the coating amount in g/m2.

(1) Neutralization Layer

Cellulose acetate (acetylation degree: 53%) (6), methyl vinyl ether-maleic acid anhydride copolymer (4), uvitex OB (trade name of product manufactured by Ciba Geigy Co.) (0.04).

(2) Neutralization Timing Layer

Cellulose acetate (acetylation degree: 55%) (8.5), 1-(4-hexylcarbamoylphenyl)-2,3-dihydroimidazole-2-thione (0.06).

(3) Image Receiving Layer

After coating cellulose acetate (acetylation degree: 53%) (1.5), palladium sulfide ($7.5\times10^{-4}$), and 1-(4-hexylcarbamoylphenyl)-2,3-dihydroimidazole-2-thione (0.02) were coated, and then the image receiving layer was formed by applying saponification from the surface using a saponifying solution prepared by dissolving 9.0 g of sodium hydroxide into 240 ml of methanol and 60 ml of water.

(4) Separation Layer

Butyl methacrylate-acrylic acid copolymer (molar ratio: 15:85) (0.03).

2. Preparation of Image Receiving Sheet (B)

An image receiving sheet (B) was prepared by disposing the following layers successively on polyethylene laminate paper as a support. Numerical values in "( )" represent the coating amount in g/m$^2$.

(1) Neutralization Layer

Cellulose acetate (acetylation degree: 53%) (6), methyl vinyl ether-maleic acid anhydride copolymer (4), uvitex OB (trade name of product manufactured by Ciba Geigy Co.) (0.04), 1-(4-hexylcarbamoylphenyl)-2,3-dihydroimidazole-2-thione (0.25).

(2) Neutralization Timing Layer

Cellulose acetate (acetylation degree: 55%) (8.5).

(3) Image Receiving Layer

Cellulose acetate (acetylation degree: 53%) (1.5), palladium sulfide ($7.5\times10^{-4}$) and 1-(4-hexylcarbamoylphenyl)-2,3-dihydroimidazole-2-thione (0.01) were coated and an image receiving layer was prepared by applying the saponification from the surface by using a saponifying solution containing 9.0 g of sodium hydroxide dissolved in 240 m( of methanol and 60 ml of water.

(4) Separation Layer

Butyl methacrylate-acrylic acid copolymer (molar ratio: 15:85) (0.03).

3. Preparation of Image Receiving Sheet (C)

The sheet was prepared in the same manner as for the image receiving sheet (B) except for using 10.7 g of sodium hydroxide dissolved in 280 ml of mehtanol and 24 g of glycerin instead of the saponifying solution for the image receiving layer (3).

4. Preparation of Image Receiving Sheet (D)

An image receiving sheet (D) was prepared by disposing the following layers successively on polyethylene laminate paper as a support. Numerical values in "( )" represent the coating amount in g/m$^2$.

(1) Neutralization Layer

Cellulose acetate (acetylation degree: 53%) (6), methyl vinyl ether-maleic acid anhydride copolymer (4), uvitex OB (trade name of product manufactured by Ciba Geigy Co.) (0.04), 1-(4-hexylcarbamoylphenyl)-2,3-dihydroimidazole-2-thione (0.10).

(2) Neutralization Timing Layer

Cellulose acetate (acetylation degree: 55%) (8.5).

(3) Image Receiving Layer

Cellulose acetate (acetylation degree: 53%)

(1.5), palladium sulfide ($7.5\times10^{-4}$) and 1-(4-hexylcarbamoylphenyl)-2,3-dihydroimidazole-2-thione (0.04) were coated and an image receiving layer was prepared by applying saponification from the surface by using a saponifying solution of 10.7 g of sodium hydroxide dissolved in 280 ml of methanol and 24 g of glycerin.

(4) Separation Layer

Butyl methacrylate-acrylic acid copolymer (molar ratio: 15:85) (0.03).

5. Preparation of Image Receiving Sheet (E)

An image receiving sheet (E) was prepared by disposing the following layers successively on polyethylene laminate paper as a support. Numerical values in "( )" represent the coating amount in g/m$^2$.

(1) Neutralization Layer

Cellulose acetate (acetylation degree: 53%) (6), methyl vinyl ether-maleic acid anhydride copolymer (4), uvitex OB (trade name of product manufactured by Ciba Geigy Co.) (0.04), 1-phenyl-2,3-dihydroimidazole-2-thione (0.15).

(2) Neutralization Timing Layer

Cellulose acetate (acetylation degree: 55%) (8.5).

(3) Image Receiving Layer

The image receiving layer was prepared in the same manner as in the image receiving sheet (D) except for using 1-phenyl-2,3-dihydroimidazole-2-thione (0.01) instead of 1-(4-hexylcarbamoylphenyl)-2,3-dihydroimidazole-2-thione (0.04) in the image receiving layer (3).

(4) Separation Layer

Butyl methacrylate-acrylic acid copolymer (molal ratio: 15:85) (0.03).

6. Preparation of Image Receiving Sheet (F)

The sheet was prepared in the same manner as the image receiving sheet (C) except for disposing the following layer (1'), i.e., an image stabilizing layer, between the neutralization layer (1) and the neutralization timing layer (2) of the image receiving sheet (C). (1') Image Stabilizing Layer Cellulose acetate (acetylation degree: 46%) (4.2) and the following compounds (2.1):

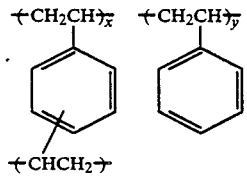

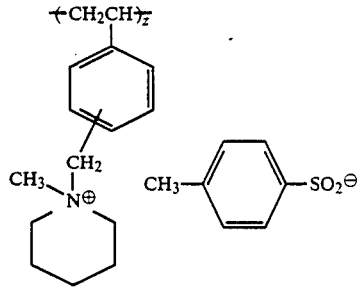

x:y:z = 5:47.5:47.5

7. Preparation of Image Receiving Sheet (G)

The sheet was prepared in the same manner as the image receiving sheet (F) except for using 10.7 g of sodium hydroxide dissolved in 290 m( of methanol and 12 g of glycerin as the saponifying solution for the image receiving layer (3).

Preparation of Photosensitive Sheet

The following layers were successively formed on a support (black polyester film):

(1) Silver iodobromide with an average grain size of 1.0 μm (iodine content: 6.5 mol%) (0.59 g/m amount), gelatin (3.5).

(2) Protective Layer:

Gelatin (0.7), polymethylmethacrylate particles (0.1).

Preparation of Processing Soltuion

| | |
|---|---|
| Potassium hydroxide (aqueous 40% KOH solution) | 323 cc |
| Titanium dioxide | 3 g |
| Hydroxyethyl cellulose | 79 g |
| Zinc oxide | 9.75 g |
| N,N-Bismethoxyethylhydroxylamine | 75 g |
| Triethanolamine solution (4.5 parts of triethanolamine based on 6.2 parts of water) | 17.14 g |
| Tetrahydropyrimidinethione | 0.4 g |
| 2,4-Dimercaptopyrimidine | 0.35 g |
| Uracil | 80 g |
| Water | 1,193 g |

The photosensitive sheet was subjected to optical wedge exposure by using a sensitometer having an optical source at the color temperature of 5,400° K. The exposed photosensitive sheet and each of the image receiving sheets in Example 4 were overlaid and diffusion transfer development was conducted while extending the processing solution to a thickness of 0.035 mm between them and separated after 30 seconds to obtain positive prints. The processing was carried out at 25° C.

The maximum density of the thus obtained positive prints was measured by using a TCD type self recording densitometer manufactured by Fuji Photo Film Co., Ltd.

As is shown in Table 6, the image receiving sheets according to the present invention have a high Dmax and give satisfactory positive images.

EXAMPLE 5

Positive prints were prepared by the same procedures as in Example 4 using the image receiving sheets, photosensitive sheet and processing solution in Example 4 except for setting the separation time as 10 minutes. After measuring them by using a TCD type self recording densitometer manufactured by Fuji Photo Film Co., Ltd. and left in the room for about 24 hours, they were aged for 7 days under the condition at 60° C. and 30% RH. Stains were evaluated by measuring the difference in Dmin before and after the aging.

Further, the storage stability was evaluated, after leaving the positive prints for 3 days under the conditions of 60° C. and 80% RH, based on the lowering in the density at a portion where the density was initially 0.5 and from the change in the tone.

As is shown in Table 6, the image receiving sheets according to the present invention were satisfactory showing less increase in stains, less lowering in the density in view of the storage stability and less change in the tone.

TABLE 6

| Image Receiving Sheet No. | Dmax | Stains | Storage Stability: Lowering in the Density | Storage Stability: Change in the Tone |
|---|---|---|---|---|
| (A) Comparison | 1.85 | 0.14 | 0.21 | poor |
| (B) Comparison | 1.63 | 0.13 | 0.15 | moderate |
| (C) Invention | 1.80 | 0.03 | 0.07 | good |
| (D) Invention | 1.83 | 0.04 | 0.06 | good |
| (E) Invention | 1.79 | 0.03 | 0.07 | good |
| (F) Invention | 1.81 | 0.04 | 0.04 | good |
| (G) Invention | 1.78 | 0.04 | 0.04 | good |

EXAMPLE 6

An image receiving sheet was manufctured in the same manner as image receiving sheet (F) in Example 4 except for using trishydroxymethylpropane and triacetine instead of glycerin in the saponifying solution for the image receiving layer (3) and then procedures as in Examples 4 and 5 were applied. Favorable results were obtained.

Example 7

As shown in Table 7 below, to the alkaline (saponification) solutions which were used in Specimen Nos. 1 ans 2 of Example 1, varying amounts (2 to 20%) of water were added, and the saponification degree of each specimens was determined and further the same experiments as Example 1 was carried out.

From the results of Table 7 below, it can be seen that the saponification proceeds depending on the amount of water inclusion and the saponifying depth is increased according to the amount of water inclusion. For example, it turns out that in the case of Specimen No. 8 (10% water inclusion), the saponification degree is almost same as the comparative specimen in which glycerine is not added.

For example, it shows that the effect of the present invention that the saponification depth is decreased by adding polyhydric alcohol or a derivative thereof can be diminished or became nothing by inclusion of water. Accordingly, in order to minimize the saponification depth, it is preferred that the saponification solution has substantially no water. In addition, it can be said that the image forming speed (maximum density) and the image degradation degree are deteriorated according to the amount of water inclusion and correspond to the saponification depth.

TABLE 7

| Specimen No. | Composition of Alkali Saponifying Solution: Glycerin (g) | NaoH (g) | Methanol (ml) | Water (ml) | Saponification Degree (neutralization titration (%) | Saponifying Depth (TEM) (μm) | Maximum Density (Dmax): 30 Second Separation | Maximum Density (Dmax): 5 Minute Separation | Image Degradation Degree (ΔD): 30 Second Separation | Image Degradation Degree (ΔD): 5 Minute Separation |
|---|---|---|---|---|---|---|---|---|---|---|
| Comparison | — | 9 | 300 | — | 61.0 | 3.0 | 1.68 | 1.81 | 0.110 | 0.163 |
| 2 | 24 | " | " | — | 41.2 | 0.8 | 1.81 | 1.81 | 0.058 | 0.089 |
| 6 (Comparison) | " | " | 294 | 6 | 48.7 | 2.3 | 1.78 | 1.81 | 0.074 | 0.104 |
| 7 (Comparison) | " | " | 285 | 15 | 56.3 | 2.8 | 1.66 | 1.80 | 0.099 | 0.148 |
| 8 (Comparison) | " | " | 270 | 30 | 61.2 | 3.2 | 1.62 | 1.80 | 0.131 | 0.189 |
| 9 (Comparison) | " | " | 240 | 60 | 67.8 | 3.9 | 1.58 | 1.77 | 0.153 | 0.202 |

While the invention has been described in detail and with reference to specific embodiments thereof, it will be apparent to one skilled in the art that various changes and modifications can be made therein without departing from the spirit and scope thereof.

What is claimed is:

1. A method for preparing an image receiving element for use in a silver salt diffusion transfer process, said method comprising:

(1) coating on a support in the recited order at least:

(a) an alkali neutralization layer, (b) a neutralization timing layer, and (c) an image receiving layer containing silver precipitation nucleus material, a cellulose ester and a substantially water free alkaline solution; and then (2) saponifying said cellulose ester with said substantially water free alkaline solution to obtain said silver precipitation nucleus material in regenerated cellulose, wherein said alkaline solution contains from 1 to 20% by weight of a polyhydric alcohol having two or more hydroxyl groups or a derivative thereof.

2. The method for preparing an image receiving element for use in a silver salt diffusion transfer process as claimed in claim 1, wherein at least one of the compounds represented by the following general formulae (I) or (II) is present in the neutralization layer and/or neutralization timing layer:

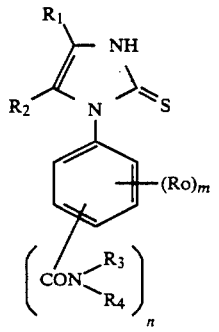

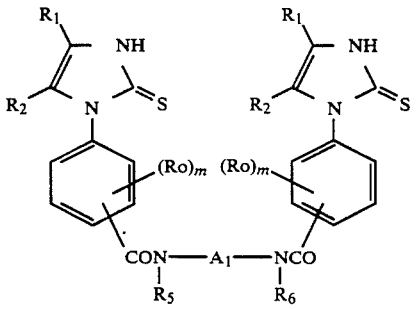

(II)

wherein Ro, which may be the same or different from each other, represents a hydrogen atom, a halogen atom, an alkyl group, a substituted alkyl group, a substituted or unsubstituted cycloalkyl group, a substituted or unsubstituted alkoxy group, a substituted or unsubstituted alkyl-sulfonyl group, a substituted or unsubstituted aryl-sulfonyl group, a sulfamoyl group, an alkyl- or aryl-sulfonamido group, a carbamoyl group, a carbonamido group, a substituted or unsubstituted heterocyclic group, a substituted or unsubstituted aryl group, an acyl group, a substituted or unsubstituted alkoxycarbonyl group, a substituted or unsubstituted acyloxy group, a substituted or unsubstituted alkylthio group, a substituted or unsubstituted arylthio group, a primary amino group or a salt thereof, a secondary or tertiary amino group substituted with an alkyl or aryl group or a salt thereof, a nitro group, a hydroxy group, a carboxyl group, a sulfonic acid group or a cyano group;

$R_1$ and $R_2$ represent a hydrogen atom, an alkyl group, a substituted alkyl group or an aryl group;

$R_3$ and $R_4$ represent a hydrogen atom, an alkyl group, a substituted alkyl group, an aryl group, a substituted aryl group or a substituted or unsubstituted heterocyclic grup;

$R_3$ and $R_4$ may form together with the N atom a 5- to 6-membered ring in which a hetero atom may further be included;

$R_5$ and $R_6$ represent a hydrogen atom, an alkyl group, a substituted alkyl group, an aryl group, a substituted aryl group or a substituted or unsubstituted heterocyclic group;

$A_1$ represents a divalent group; m represents 0 or an integer of from 1 to 4; and n represents 0, 1 or 2.

3. The method for preparing an image receiving element for use in a silver salt diffusion transfer process as claimed in claim 1, wherein a lower alcohol is used as a solvent for the alkaline solution.

4. THe method of preparing an image receiving element for use in a silver salt diffusion transfer process as claimed in claim 1, wherein said saponifying step is conducted such that a saponification depth is not more than about 24 μm as observed with a transmission type electronic microscope.

* * * * *